US005535569A

United States Patent [19]

Seccombe et al.

[11] Patent Number: 5,535,569

[45] Date of Patent: Jul. 16, 1996

[54] SHEET METAL STRUCTURAL MEMBER AND FRAMES INCORPORATING SAME

[75] Inventors: Campbell J. Seccombe, Normanhurst; Brad F. Golledge, Kirrawee; Peter R. Field, Strathfield; Peter J. Hunt, East Blaxland, all of Australia

[73] Assignee: BHP Steel (JLA) Pty, Ltd., Sydney, Australia

[21] Appl. No.: 290,783

[22] PCT Filed: Mar. 5, 1993

[86] PCT No.: PCT/AU93/00092

§ 371 Date: Sep. 2, 1994

§ 102(e) Date: Sep. 2, 1994

[87] PCT Pub. No.: WO93/18244

PCT Pub. Date: Sep. 16, 1993

[30] Foreign Application Priority Data

Mar. 6, 1992 [AU] Australia ..... PL1234
Nov. 30, 1992 [AU] Australia ..... PL6105

[51] Int. Cl.[6] ..... E04C 3/16

[52] U.S. Cl. ..... 52/634; 52/729.1; 52/729.5; 52/731.7

[58] Field of Search ..... 52/731.2, 731.3, 52/729, 731.7, 639, 731.5, 731.7, 731.8, 641, 729.1, 729.5

[56] References Cited

U.S. PATENT DOCUMENTS

| | | | |
|---|---|---|---|
| 518,645 | 4/1894 | Crittenden | 52/729 X |
| 991,603 | 5/1911 | Brooks | 52/364 |
| 3,083,794 | 4/1960 | Stovall | 52/729 X |
| 3,404,496 | 10/1968 | Ballard | 52/641 X |
| 3,646,725 | 3/1972 | Troutner | 52/641 |
| 3,785,108 | 1/1974 | Satchell | 52/641 X |
| 4,881,355 | 11/1989 | Bosl et al. | 52/729 X |

FOREIGN PATENT DOCUMENTS

| | | | |
|---|---|---|---|
| 2459421 | 12/1974 | Germany | 52/729.5 |
| 9117328 | 11/1991 | WIPO | 52/729 |

*Primary Examiner*—Carl D. Friedman
*Assistant Examiner*—David Jersen
*Attorney, Agent, or Firm*—Nikaido, Marmelstein, Murray & Oram

[57] ABSTRACT

A sheet metal, elongate structural member is cold roll-formed from a strip of sheet metal no thicker than 1.2 mm, preferably 0.6 mm, including a central zone and two edge zones flanking the central zone and each having a free edge margin. The member includes a substantially planar web (9), a first hollow flange (10) extending along one edge of the web (9) and projecting laterally to both sides of the web, and a second hollow flange (11) extending along the other edge of the web (9) and projecting laterally to one side only of the web. The web (9) includes the central zone and the margins (17, 23) of the original strip secured flatly together by clinches (18, 29), and the hollow flanges are formed from the edge zones of the original strip excluding the margins thereof. The spacing of the clinches is selected so that the shear point of the member's section substantially coincides with the plane of the web.

16 Claims, 8 Drawing Sheets

SHEET METAL STRUCTURAL MEMBER AND FRAMES INCORPORATING SAME

TECHNICAL FIELD

This invention relates to elongate structural members for use in load bearing frames comprising a reticulation of such members joined each to each. The inventive structural members are well adapted, but not exclusively so, for use in triangulated frames, that is to say frames wherein the rigidity of the frame as a whole results from the triangular arrangement of the members rather than from the rigidity of the joints between members.

The invention is concerned with members that are cold-formed from sheet metal, but, within that limitation has several aspects, namely the nature of the members themselves, the method of manufacture of the members, and the nature of joints between members in a frame. The invention also extends to structural frames assembled from members and/or utilizing joints in accordance with the relevant aspects of the invention.

BACKGROUND ART

Prior known elongate structural members that are cold-formed from sheet metal, for example, by rolling, folding or pressing a metal strip, have typically been essentially channel, Z or I sectioned. That is to say, they have usually comprised a web with flanges projecting from the edges of the web. The original strip which may, for example, be steel strip coated with zinc or an alloy of aluminium and zinc, is necessarily relatively thin, say two or three millimetres thick, to render it cold-formable, but the resultant light weight structural members are suitable for use in structures subjected to relatively modest stresses. For example, they find widespread use as the structural members of wall frames and roof trusses in dwellings, sheds, small commercial buildings and the like.

DISCLOSURE OF THE INVENTION

When the flanges of such structural members are subjected to axial compression, either directly or as a result of bending loads on the member, failure frequently originates from buckling of the flange's free edge remote from the web. Of course, other modes of failure may occur, for example the sudden collapse of a member functioning as a strut, if an adventitious bending lead causes displacement of a center portion of the member due to rotation thereof about the shear point of the member's section.

Generally speaking, the design of structural members becomes more exacting and critical as the thickness of the metal decreases. The lighter the gauge of the sheet metal the more likely is a catastrophic, progressive type failure originating in the unintended or excessive deflection of a small part of the section. On the other hand, it is desired to reduce the metal thickness as much as possible so as to reduce the material cost and the weight of the member.

Therefore, an object of the present invention is to provide a structural member of the kind under discussion that is made from light gauge sheet metal, no more than 1.2 mm thick, and which has a greater lead bearing capacity and is more stable under lead than conventional members of equivalent weight per unit length.

The building industry in respect of domestic housing and like buildings is very competitive and every effort is made to contain costs, both in regard to the structural members used and in the erection of prefabricated or other frames made from them. Thus, it is desirable that the members be suitable for manufacture by automatic and quick production processes, that their design be such that efficient use of material is achieved and that they lend themselves to simple on-site assembly by relatively unskilled labour.

Thus, another object of the invention is to provide a light gauge, cold-formed, sheet metal structural member that meets those desiderata.

The invention consists in a cold-formed, sheet metal, elongate structural member having a metal thickness not exceeding 1.2 millimetres, comprising a substantially planar web having two longitudinally extending edges, a first hollow flange extending along one edge and projecting laterally to both sides of the web, and a second hollow flange extending along the other and projecting laterally to one side only of the web.

The invention also consists in structural frames incorporating one or more of the inventive members.

In preferred embodiments of the invention the member is cold roll-formed from a substantially flat strip of sheet metal not exceeding 1.2 mm in thickness, and each hollow flange is formed from an edge zone of the original strip. Each such edge zone is returned on itself as the strip is roll-formed to form a hollow flange, and the free edge margin of the edge zone is held flatly against one side of the central zone of the strip between the edge zones. The contacting areas are secured together by fastening means, either continuously along a longitudinal line of the member or intermittently at spaced intervals along such a line, so that each hollow flange is a substantially complete tube and the structural member's web, being composed of the central zone and the edge margins of the original strip, is, at least in part, of double thickness. This construction results in a structural member, when functioning as a beam, that has flanges that are more resistant to bending, or a web that is more resistant to shear, or both of these attributes, by comparison with conventional I-beam or channel sectioned members made from a similarly sized original strip.

The fact that one of the flanges projects in both directions from the web, enables that flange to carry external loads and to transfer those loads to the web more nearly in the plane of the web, thereby loading the web more nearly in direct shear, that is to say with less torsional stress in the web, than would be the case with a less symmetrical lead receiving flange, such as either flange of a conventional channel or angle sectioned member.

The facts that the web is substantially planar, and that one of the hollow flanges projects in one direction only, facilitate the making of T-joints and like joints between the end of one member and another member that is continuous at the joint, in that the discontinuous member may lie flatly against the web of the continuous member for affixture by a simple through fastener, or in that a simple, substantially flat, coupling plate may be used that extends from one member to the other across the joint and bears flatly against the weds of both of them for ready affixture thereto, The fact that the hollow flanges are essentially tubular enables other components to be nailed to a flange by means of a nail penetrating the material of the flange at two spaced apart points along the length of the nail, one where the nail enters the flange and one where it departs from the flange. That double engagement prevents the nail from tilting to and fro under directionally fluctuating external loads and enables it to remain tightly held by the member. This is not normally possible with conventional light gauge sheet metal components using conventional hammer-in nails, and is of considerable significance in that simple nailing probably remains the quickest and simplest form of fastening yet devised.

Thus it will be apparent that a structural member according to the invention presents a plurality of features which, in their totality and interrelationship, enhances the extent to which such members, and frames incorporating them, may fulfill the several desiderata mentioned earlier. Further design refinements leading to the ability to create a stable and effective load bearing frame from very light gauge sheet metal will become apparent from the following description of a number of preferred embodiments.

BRIEF DESCRIPTION OF THE DRAWINGS

By way of example, several embodiments of the above described invention are described in more detail hereinafter with reference to the accompanying drawings.

BEST MODES OF CARRYING OUT THE INVENTION

Figure 2:
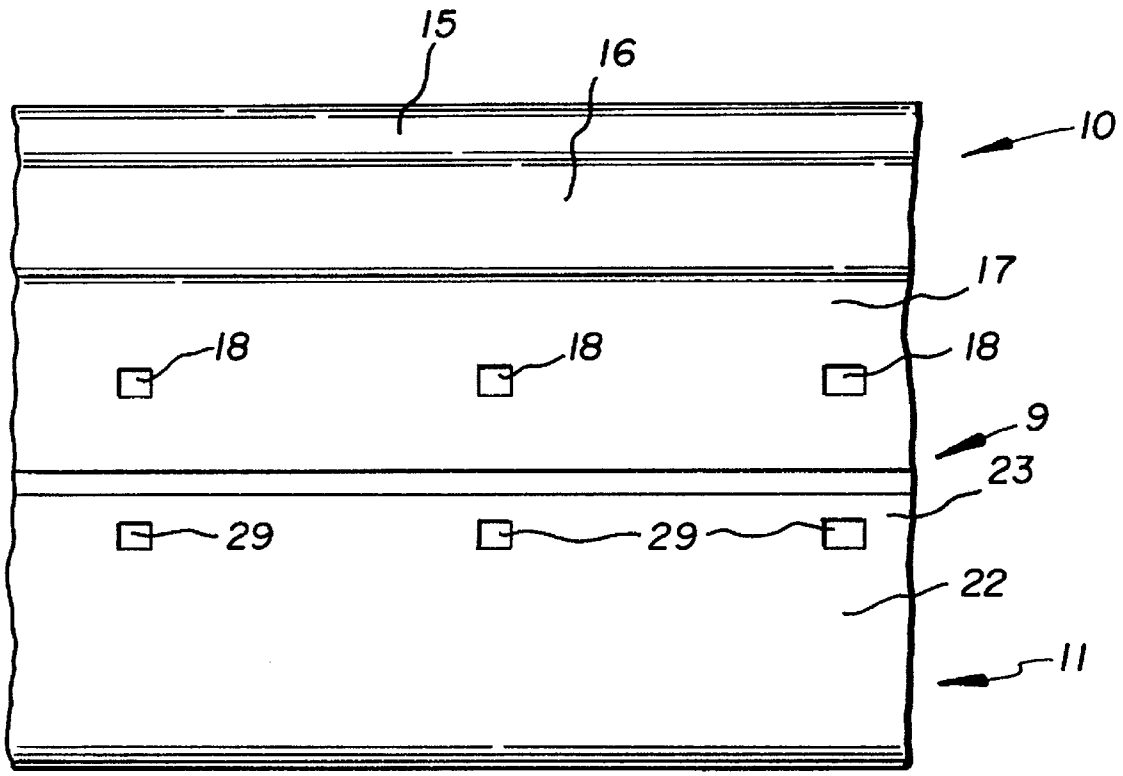
FIG. 2 is a side elevation of a portion of the structural member of FIG. 1.
Figure 1:
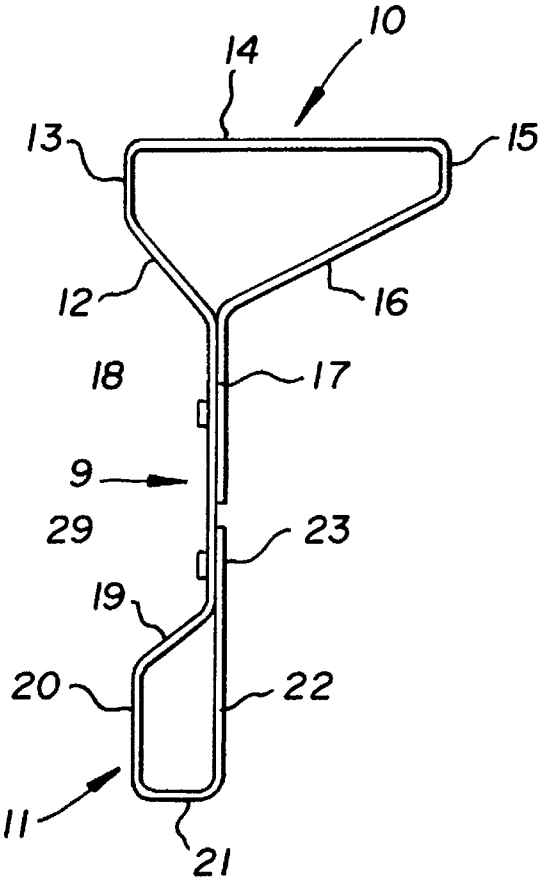
FIG. 1 is an end elevation of a structural member according to the invention.

The structural member illustrated by FIGS. 1 and 2 may be roll-formed from thin, high-tensile, preferably galvanised, steel strip, for example strip no more than 1.2 mm thick. For preference the strip is within the range of from 0.4 to 0.8 mm in thickness, with a most preferred value of substantially 0.6 mm. It may be roll-formed by the single passage of an initially flat strip of appropriate width through a series of stands of forming rolls which successively modify-the shape of the strip passing through them. That strip may be said to comprise a central zone flanked by edge zones having free edge margins.

The member comprises a web 9 comprising the central zone of the original strip and two hollow flanges 10 and 11 respectively formed from the edge zones of the strip excluding their edge margins.

Flange 10 comprises a tubular body of pentagonal cross-section, comprising flange walls 12 to 16 respectively. It will be seen that the flange 10 projects laterally to both sides of the web 9. Flange wall 12 is integral with the central zone of the original strip and flange wall 16 is integral with an edge margin 17 of the original strip. Flange wall 14 is referred to as the load bearing wall, in that articles resting upon or supported by the member would normally rest upon it, The central zone of the original strip and its margin 17 are secured flatly together by fastening means comprising, in this instance, a row of uniformly spaced apart clinches 18 adapted to hold that zone and that margin in contact, and to transfer shear loads therebetween, so that each effectively becomes part of, and contributes to the strength of, the web 9 of the structural member, Such clinches are well known. They are produced by laterally displacing small areas of metal from the two pieces joined and then spreading the displaced metal to prevent its return. They may be made by means of rotary dies of known kind, and in effect such dies preferably comprise the last met stand of the aforesaid series of stands of forming rolls. Although preferred because of their simplicity and ease of formation, the clinches 18 may be replaced in other embodiments by other conventional fastening means, for example line or spot welds, rivets or adhesive.

The load bearing flange wall 14 preferably has a width substantially equal to the maximum width of the flange 10, preferably is normal to the web 9, and preferably is substantially flat so as to present a substantial load bearing area normal to the web to any item to be supported by the member that rests upon the flange. Such an item may be nailed to the flange 10 by a nail extending through the item and the flange. Such a nail may penetrate the wall 14, extend across the hollow interior of the flange, and then emerge by piercing the wall 16. As indicated earlier, this ensures that the nail is more effectively gripped than it would be if it penetrated a single thickness of the sheet metal. The nail may be driven by a conventional nailing gun or by a hand held hammer.

The flange 10 projects laterally of the web more in one direction than in the other. This provides for more latitude in the positioning of such nails. However, the out of symmetry must not be taken to extremes, and in accordance with the invention there is substantial projection of the flange 10 to both sides of the web 9. In the present instance this doubly projecting flange projects about three times as far in one direction as it does in the other. The criteria governing the preferred proportions of the flange 10 in a member constituting a chord of a truss will be discussed more fully below with reference to FIG. 12.

The flange 11 comprises a hollow body of quadrangular cross-section, comprising flange walls 19 to 22 respectively. Wall 22 is integral with the opposite edge margin 23 of the original strip, and that edge margin is clinched to the strip's central zone by clinches 29 corresponding to clinches 18. Thus, both edge margins of the original strip and its central zone are incorporated in the web of the roll-formed member.

Flange 11 may also be nailed, but is not shaped specifically with that capability as a paramount consideration. More importantly it projects laterally in only one direction from the web, so that a broad flat face, comprising the right hand surfaces (as seen in FIG. 1) of original edge margins 17 and 23 is provided for face to face contact with a coupling plate, or the web of a second, similar member, that may be joined to the web 9 by conventional through fasteners.

The flange 11 does not provide so much lateral stability as does the flange 10, and therefore where the member is used in a situation in which it is subjected to bending stresses it is preferable for the flange 11 to be the flange that is placed in tension.

The invention was devised primarily, but not exclusively, to produce members for use as the top and bottom chords of roof trusses, and another embodiment is now described more particularly in that context with reference to FIGS. 3 to 8.

The truss illustrated by those figures comprises two inclined top chords 30, a bottom chord 31 and a plurality of internal members 32.

A widely used form of roof covering comprises terra cotta tiles, concrete tiles, slates or other small cladding pieces. Those tiles or tile-like cladding pieces are supported by tile battens fixed to the top chords of roof trusses. As each tile or cladding piece is small, considerable numbers of tile battens are needed, It is therefore highly desirable for the battens to be fixable to the trusses quickly by inexpensive fasteners. Thus it is desirable for the battens to be nailable to the trusses. To that end the top chords 30 are in accordance with the invention, and in this exemplary embodiment are Substantially identical to the structural member described above with reference to FIGS. 1 and 2. Therefore, the chords 30 are not described in detail below.

Figure 8:
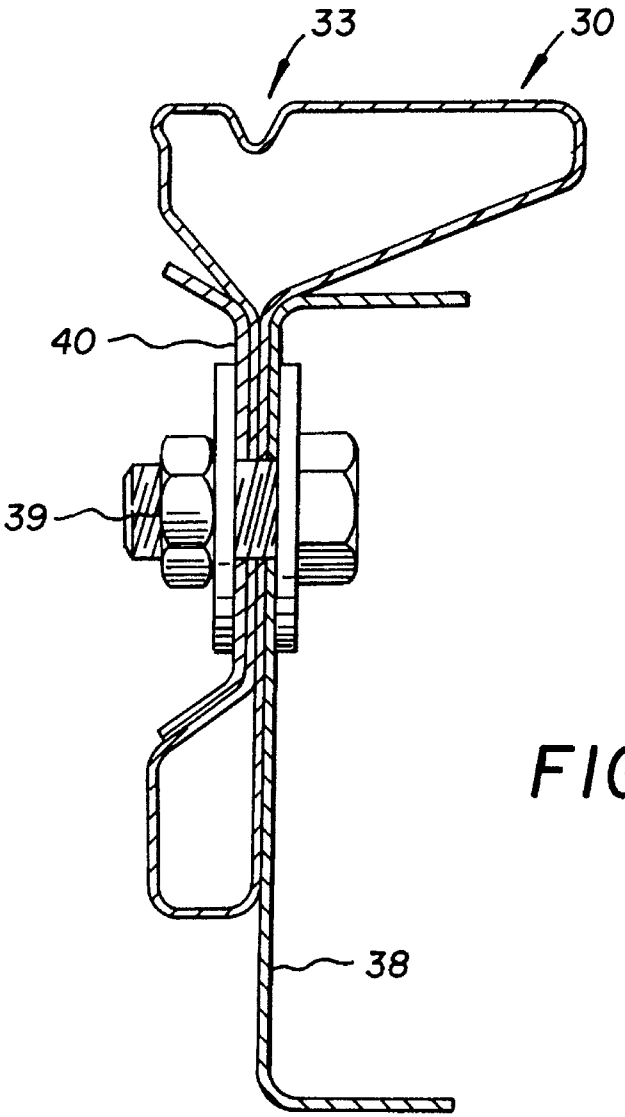
FIG. 8 is a sectional view taken generally on line 8—8 of FIG. 7.
Figure 6:
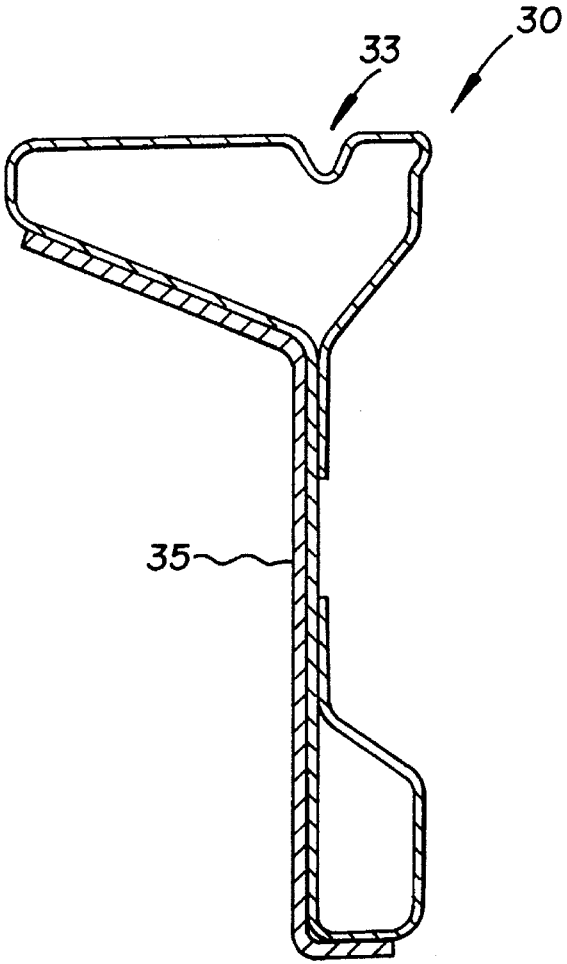
FIG. 6 is a sectional view taken on line 6—6 of FIG. 4.

As may best be seen in FIGS. 6 and 8, the chords 30 are disposed with their first hollow flanges, those that correspond to flange 10 of the earlier described embodiment, uppermost. The primary difference between the chords 30 and the FIG. 1 member is the provision of a marker groove 33 in the load bearing wall of the flange, which groove is in substantial alignment with the web of the chord 30. The groove 33 indicator the position of the web to a per, on nailing tile battens to the top chord, and assists him or her to position the nails correctly, so that they pierce the hollow flange and avoid the web.

The bottom chord 31 has the same cross-section as the top chords 30, although, as assembled in the truss the bottom chord 31 is inverted compared to the top chords 30. As well as permitting the easy connection of the braces 32 to the bottom chord, this exposes the lead bearing wall of the doubly projecting flange for the receipt of fasteners for securing ceiling battens to the bottom chord.

The braces 32 are conventional channels or, more preferably C-sectioned members that is to say channels with inturned lips extending along the free edges of the channel flanges, and may be joined to the chords by conventional means, such as rivets or clinches.

However it is well known in respect of triangulated structural frames, that if the loads to be borne are applied at the joints and the joints have little or no stiffness in the plane of the frame, then the individual members are not subjected to significant bending stresses. This allows the members to be, long and slender and results in efficient use of material. Thus the braces 32 are preferably pinned to the chords 30 and 31 by a single through bolt or the like extending through the webs of the chord and brace where they overlap at each end of each brace (except at the apex of this truss, where such through bolts 34 may extend through a coupling plate extension of each top chord's web as will be described below). It should be noted that the inventive cross-sectional shape of the chord members allows the ends of the webs of the braces to lie flatly against the webs of the chords, enabling such a simple and effective joint to be used.

The top chords 30 at the apex (see FIGS. 4, 5 and 6) are fixed to flanged coupling plates 35 that are hingedly pinned together and, in this instance, to two of the braces 32. The pinning may be effected by a bolt 36 extending through flat overlapping body parts of the plates 35 in face to face contact. Alternatively a hollow rivet or other generally cylindrical through fastener may be used. This provides a joint having no appreciable stiffness against bending about the axis of the fastener.

The plates 35 conform to the shape of the chords 30, so that their flat body parts may lie flatly against the webs of the chords to which they are secured. They may be so secured by clinches 37, or other conventional fastening means.

At each of the eaves joints (FIGS. 7 and 8) a somewhat similar, flanged coupling plate 38 is provided. It is secured to the bottom chord 31 in the same way as the plates 35 are secured to the top chords 30. The plate 38 is pinned to the adjacent top chord 30 by a through fastener, such as bolt 39 or the like and preferably the web of the chord is reinforced at the joint by a stress transfer plate 40 pierced by the bolt 39 and, preferably, clinched to the top chord web by clinches (not shown).

Figure 3:
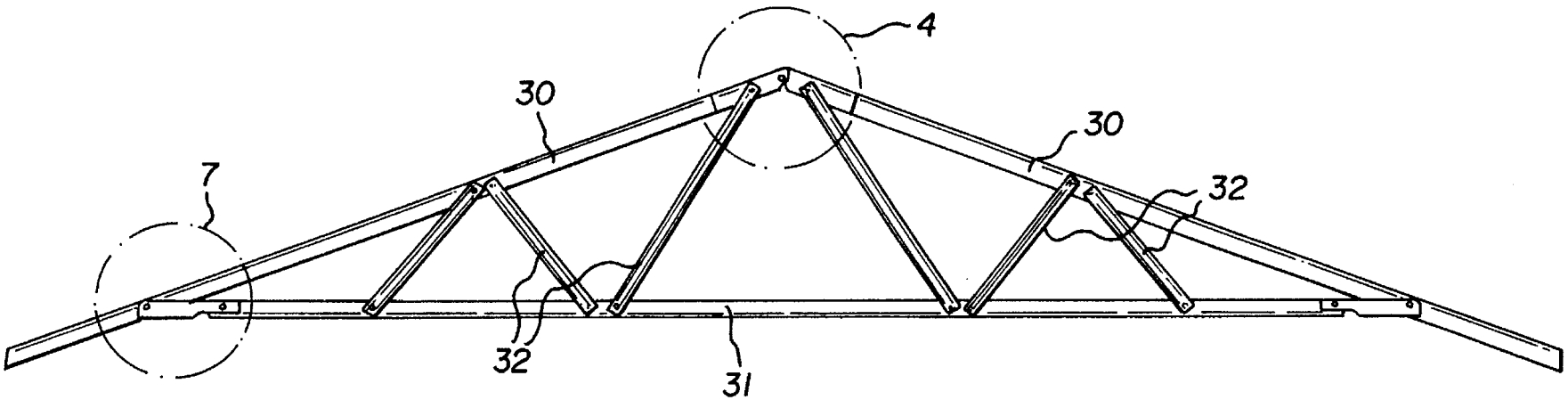
FIG. 3 is a side elevation of a simple roof truss, being an example of a triangulated frame incorporating structural members according to the invention.

The truss illustrated by FIGS. 9 to 12 may have top chords 30, a bottom chord 31 and internal members 32 of the same sections as the correspondingly numbered components of the FIG. 3 truss. However the number and lay-out of the internal members may be different, and the apex and eaves joints are different.

At the apex the webs of the two chords 30 are sandwiched between two coupling plates 41 and 42 respectively, and secured At the apex the webs of the two chords 30 are sandwiched thereto by through bolts 43. Coupling plate 41 is essentially a flat plate with upper and lower stiffening flanges 44 and 45 respectively. Coupling plate 42 is a chevron shaped plate with inclined edge flanges 46 and 47 respectively adapted to nest against the flange walls 12 and 19 (as identified in FIG. 1) respectively. This arrangement locks the plate 42 to each of the chords 30 and prevents substantial vertical play between the chord ends. However the tolerances in this type of work are such that there is still enough movement possible, by each chord in rotation about its associated bolt 43, for the joint to behave as a pin joint.

The coupling plate 41 projects below the chords 30 and serves as a gusset plate for C-sectioned internal truss members 32, They are pinned to the coupling plate by through bolts 57 extending through the webs of the members 32, the plate 41 and a rectangular washer 48.

Figure 4:
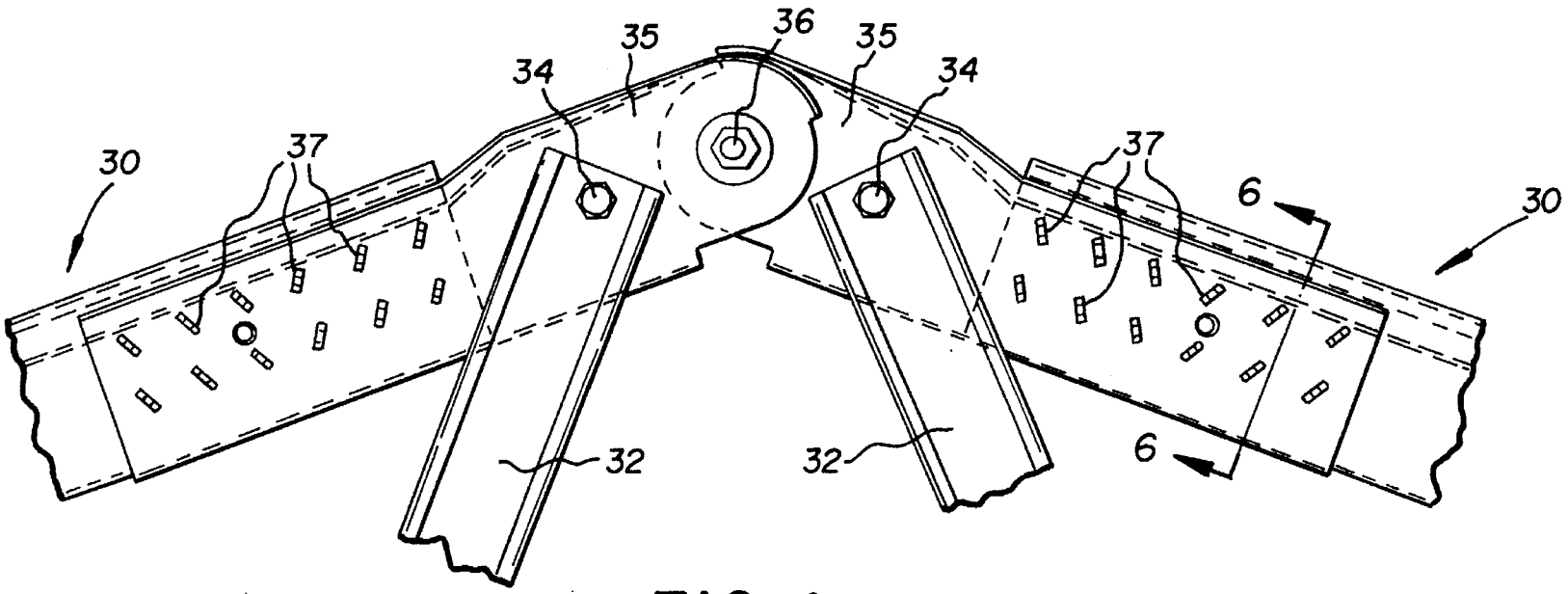
FIG. 4 is a side elevation of the apex of the truss of FIG. 3 appearing within the enclosure marked 4 in that figure, drawn to a larger scale.
Figure 5:
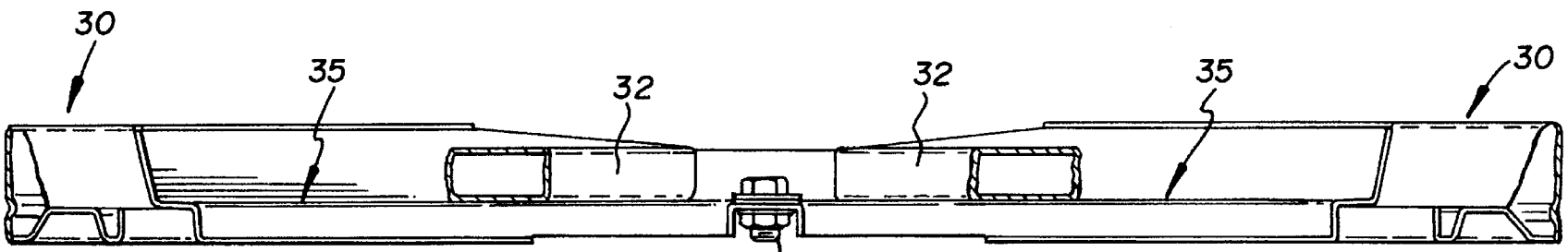
FIG. 5 is of the apex of FIG. 4 when viewed from below.

An advantage of this apex joint over the FIG. 4 joint is that the doubly projecting, load bearing flanges of the chords almost meet at the apex. This enables tile battens to be positioned close to the apex in the same way as elsewhere in the roof thus obviating the need for special arrangements for supporting the tiles in the two courses immediately adjacent the apex of the roof.

Figures 9, 9A, 9B:
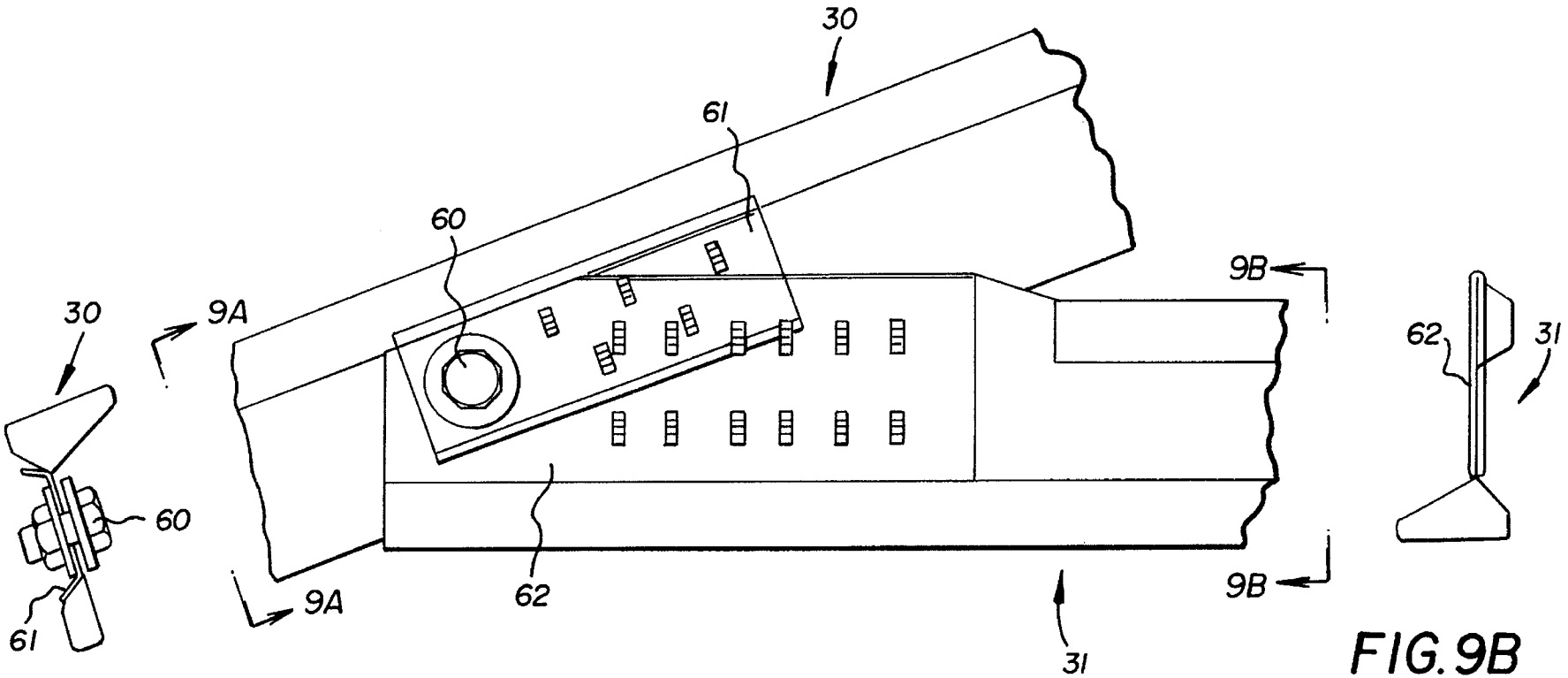
FIG. 9 is a view similar to FIG. 7 of an alternative truss eaves joint.
FIGS. 9A and 9B are detail end views of the chords meeting at the joint as seen in the directions of the arrows A and B respectively.
Figure 10A:
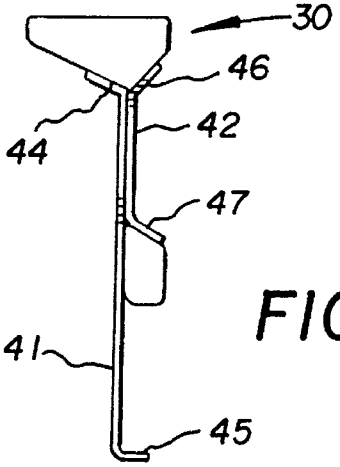
FIG. 10*a* is an end view of one of the chords meeting at the apex and a sectional view of the coupling plates associated with it.

FIGS. 9, 9A and 9B illustrate an eaves joint between a truss top chord 30 and bottom chord 31. Both chord members are shown as being in accordance with the FIG. 1 member. For preference, however, their doubly projecting load bearing flanges would be provided with marker grooves in the manner of the chords of the FIG. 3 truss.

Figure 7:
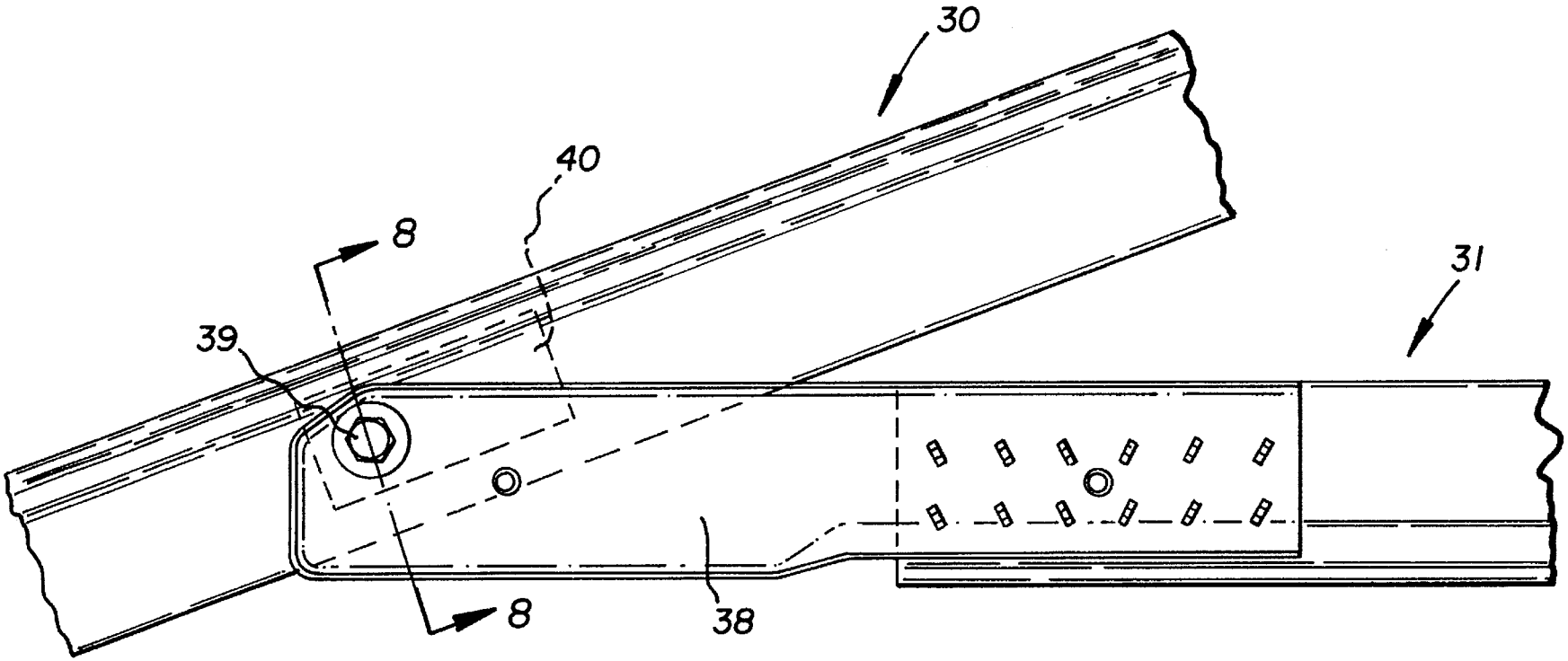
FIG. 7 is a view similar to FIG. 4 of an eaves joint of the truss of FIG. 3 appearing within the enclosure marked 7 in that figure.

The chords are pinned together by a through bolt 60. To provide adequate bearing area between the bolt and the chords, each is reinforced or thickened around the bolt hole by reinforcing elements 61 and 62 clinched or otherwise secured to the respective chords. The reinforcing element 61 is a flanged plate adapted to lie against the web of chord 30 with the element flanges located against the chord's hollow flanges in the case of the bottom chord, its singly projecting hollow flange has been flattened at the end and the flattened flange and the chord's web have been encased in a narrow, inverted U shaped cover, constituting the reinforcing element. An advantage of this joint over that of FIG. 7 is that the load bearing flange of the bottom chord 31 extends to the end of the chord. This enables the chord to sit directly upon a wall plate and avoids any requirement for non-standard arrangements for the affixture of ceiling panels to the under side of the truss.

Figure 11:
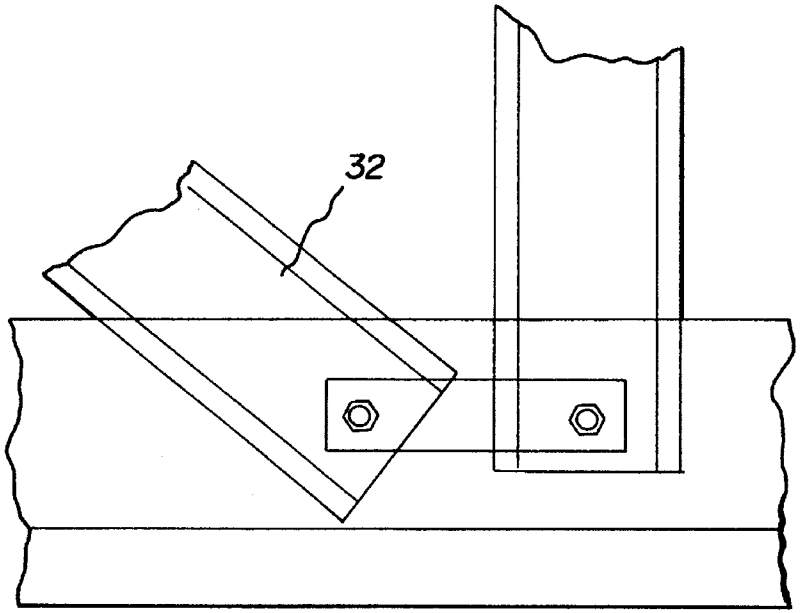
FIG. 11 is a side elevation of a joint between a truss bottom chord and two truss internal members meeting at the joint.
Figure 10:
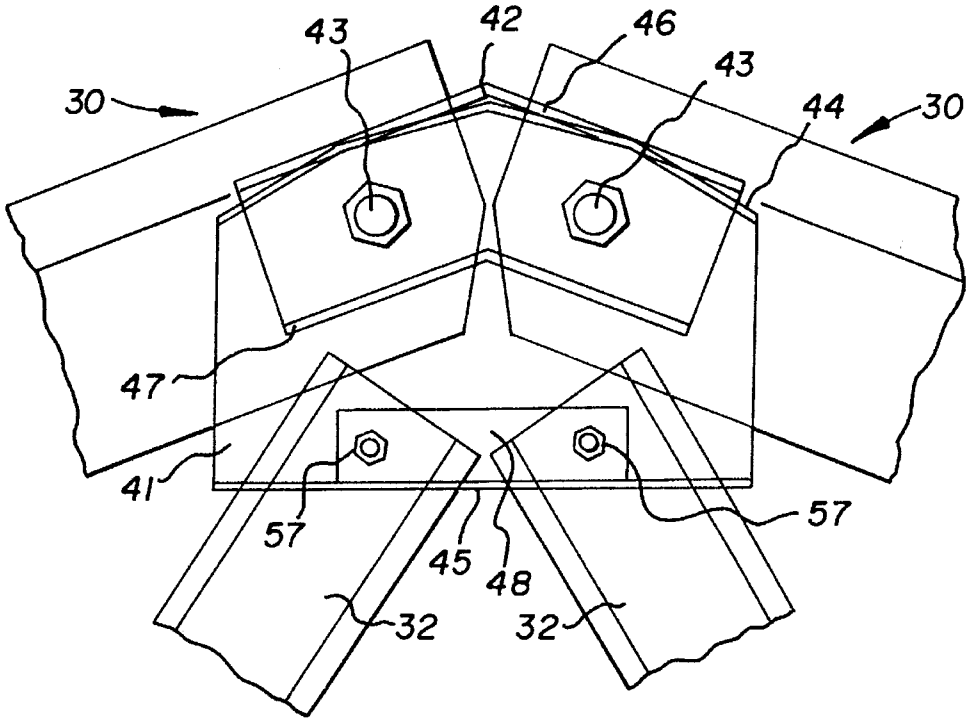
FIG. 10 is a view similar to FIG. 4 of an alternative truss apex.

FIG. 11 shows a joint between two internal members 32 and the lower chord 31 wherein the members are secured to the web of the chord in exactly the same way as the internal members of FIG. 10 are joined to the plate 41.

An important parameter of a sheet metal section, particularly one made from very thin metal, is the position of the so called "shear point". If a long beam, particularly one of thin sheet metal, is supported at the ends and loaded at the center of its span, it may fail, depending on the beam's cross-section, in a manner causing a center portion of the beam to rotate bodily out of the line of the beam. The center of that bodily rotation is the shear point. It is a unique parameter for each section and may lie outside the ambit of the beam's cross-section. Ideally, the shear point is in the line of action of the applied load, in which event this type of failure is precluded. For this reason it is normally considered good practice to use beams, and truss chords loaded by tile battens at points remote from the truss joints are in fact beams, of a cross-section that is symmetrical about the vertical center line. Under that circumstance the shear point is on the center line and the line of action of evenly applied gravitational loads normally pass through it. It is also important for the shear point to be high relative to the point of application of the load. This promotes stability of the system. If the shear point is above the point of application of the load and the line of action of the load passes through it, the system is in stable equilibrium, in that if an adventitious load (for example, a non-vertical load due to wind pressure on the roof) causes the chord to commence to turn about the shear point, then the gravitational load produces a restoring moment. On the other hand if the shear point is well below the point of application of the gravitational load, the system is in unstable equilibrium, in that if any disturbance causes the shear point to depart from the line of action of the applied load, then the load produces a moment tending to increase that departure. These and similar catastrophic buckling type failures are of particular concern when members made from very thin sheet metal are involved. Such members do not have the overstrength. normally present in member's of thicker material which enables them to absorb load disturbances without drastic deflection of a part or the whole of the member's section.

Figure 12:
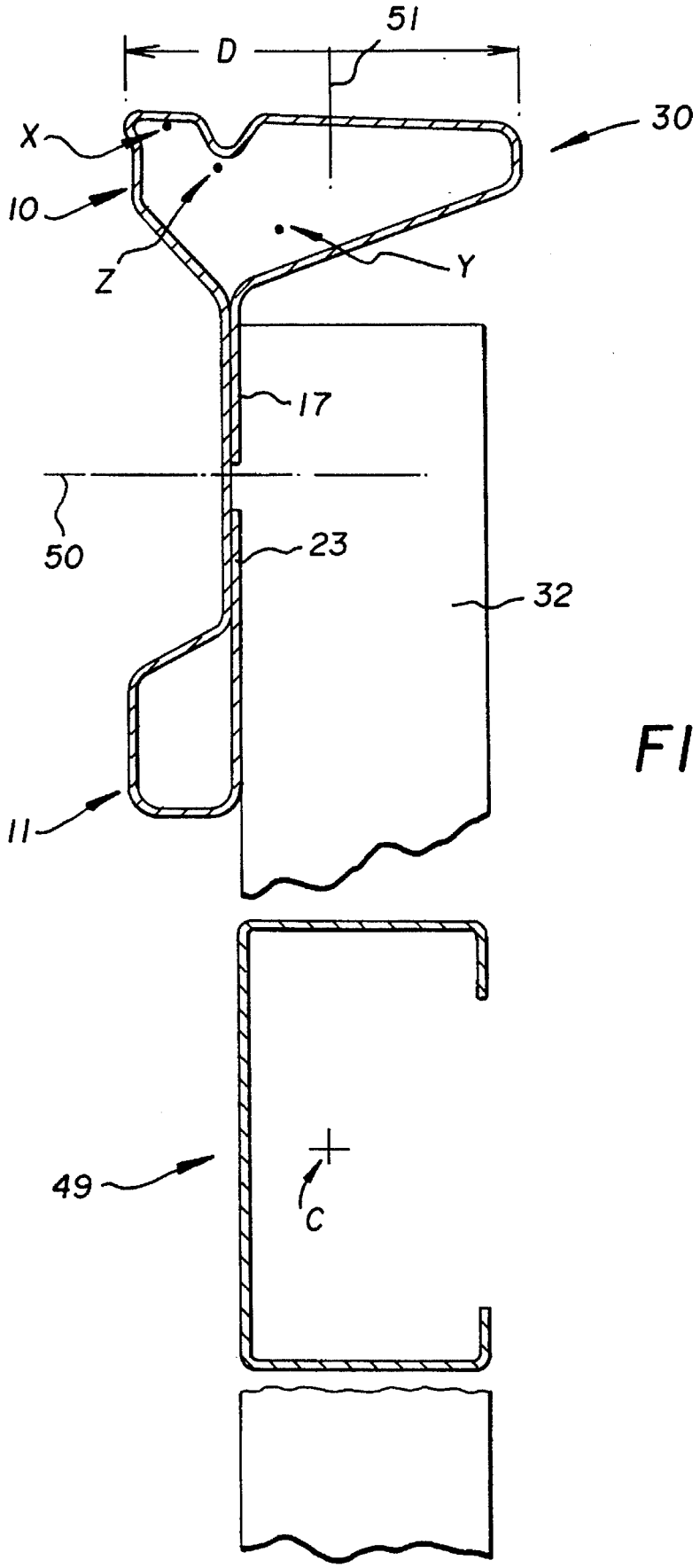
FIG. 12 is a cross-sectional view of a truss top chord and a truss internal member making a T-joint with the chord.

Turning now to FIG. 12, it will be seen that an internal truss member 32 is connected to a top chord according to the invention. The member 32 is of a standard C-section, as shown at 49 and is secured with its web flatly against the web of the chord 30 by a through fastener or the like centered on center line 50.

Obviously the chord 30 is a non-symmotrical section, as are all structural members according to the invention. However it has boon found that the position of the shear point of that section is high, and perhaps of more importance, its lateral position relative to the web of the member may be adjusted or modified by modifying the rigidity of the restraint offered by the fastening means securing the edge margins 17 and 23 of the original strip to the center zone thereof; that is to say the degree of integrity of the hollow flanges when considered as tubes, The limit positions correspond to a total absence of fastening means on the one hand, and a continuous seam weld, or the like on the other, and it has been found that modification of the spacing between the fasteners of a row of fasteners, for example the preferred clinches can affect the position of the shear point. The shear point of the illustrated section in the absence of fastening means is indicated at X in FIG. 12 that of the section if the fastening means are completely rigid (for example, a continuous weld or unyielding adhesive) is indicated at Y and that of the section with the preferred fastening means, a row of clinches, each about 3×5 mm in size, at substantially 25 mm center to center spacing, is indicated at Z. The last mentioned is preferred because the point is high and in substantial alignment with the web of the section. This leads to a, very stable system in respect of loads applied to the load bearing flange.

The dimensions of the truss components are such that the maximum width of the truss as a whole is the dimension D, being the width of the load bearing wall of the doubly projecting hollow flange. In practice that dimension may be 40 mm. This is important commercially in that 40 mm is an industry standard for the widths of the members of competing timber trusses, and if a metal truss according to the invention exceeded that width it would be at a commercial disadvantage, in that a lesser number of such metal trusses could be stacked on a truck or other transporter by comparison with a comparable timber truss. The internal member 32 has outer dimensions of 50 mm by 25 mm. Thus the doubly projecting hollow flange projects a little less than three times as far from the center line of the chord's web in one direction than it does in the other, so as to ensure that the maximum projection is a little more than 25 mm. The singly projecting hollow flange 11 projects substantially the same amount as does the smaller side of flange 10.

A further consequence of this combination of a non-symmetrical chord and internal member is that the line of action of a uniform lead resting on the top chord of the truss, such as the lead transferred to it by a tile batten, coincides with the center line 51 of the flange's lead bearing wall, which in turn substantially coincides with the centroid C of the member 32. That coincidence enables the transfer of the loads between the members to be direct and this in turn reduces the likelihood of buckling type failures, inherent in the use of very thin sheet metal sections. In short the invention has regard to the entire truss assembly and as it were, "tunes" the components to produce a more efficient overall result instead of the more usual approach of considering each component individually, and optimizing the design of each, which in the case of a truss chord would almost certainly preclude the use of a non-symmetrical section.

We claim:

1. A cold-formed, sheet metal, elongate, structural member having a metal thickness not exceeding 1.2 millimeters, comprising:

a planar web having two longitudinally extending edges;

a first hollow flange extending along one said edge and projecting laterally to both sides of the web; and a second hollow flange extending along the other said edge and projecting laterally to one side only of the web, each of said hollow flanges having a margin fastened to the web by fastening means wherein a shear point of a section of said structural member is in a plane of the web.

2. A structural member according to claim 1 wherein said metal thickness is within the range of from 0.4 to 0.8 mm.

3. A structural member according to claim 2 wherein said metal thickness is substantially 0.6 mm.

4. A structural member according to claim 1 wherein said first hollow flange projects to a greater extent to one side of the web than it does to the other side of the web.

5. A structural member according to claim 4 wherein said first hollow flange projects substantially three times as far to said one side as it does to said other side.

6. A structural member according to claim 1 wherein said first hollow flange comprises a load bearing wall that constitutes the widest part of the member, is substantially normal to the structural web and is substantially flat.

7. A structural member according to claim 6 wherein a marker groove extends longitudinally of said load bearing wall in substantial alignment with the web.

8. A structural member according to claim 1 wherein said fastening means comprise a plurality of equally spaced apart fasteners provided in a line extending longitudinally of the structural member.

9. A structural member according to claim 8 wherein each said fastener is a clinch.

10. A structural member according to claim 8 wherein spacing of said plurality of equally spaced apart fasteners is selected such that the shear point of the section of the structural member is in alignment with the plane of the web.

11. A method of making a structural member according to claim 1 comprising the steps of passing a substantially flat strip of sheet metal through a series of stands of forming rolls which successively modify the shape of the strip passing through them to bring it into the shape of the member and fastening said margins to said central zone.

12. A method according lo claim 11 wherein the stand of rolls last met by the strip comprises rotary dies which effect said step of fastening by clinching said central zone and said margins together.

13. A method according to claim 12 wherein the spacing of said clinches is selected so as to ensure that the shear point of the section of the structural member is in alignment with the plane of the web.

14. A structural frame comprising at least one structural member according to claim 1.

15. A truss comprising top chords and a bottom chord that are structural members according to claim 1, and a plurality of internal members such that the maximum width of the truss is that of said chords.

16. A truss according to claim 15 wherein the centroids of said internal members and the center lines of said first flanges of said chords all lie substantially in one plane.

* * * * *